US006032911A

United States Patent [19]

Osborne

[11] Patent Number: 6,032,911

[45] Date of Patent: Mar. 7, 2000

[54] WEAPON SUPPORT

[76] Inventor: Joseph Eddie Osborne, 369 St. Rose Lebanon Rd., Springfield, Ky. 40069

[21] Appl. No.: 09/130,129

[22] Filed: Aug. 6, 1998

[51] Int. Cl.[7] ..... A47F 5/00

[52] U.S. Cl. ..... 248/309.1; 248/229.15

[58] Field of Search ..... 248/309.1, 229.15, 248/405, 176.1, 177.1

[56] References Cited

U.S. PATENT DOCUMENTS

| | | | |
|---|---|---|---|
| 4,729,363 | 3/1988 | Skyba | 124/23 R |
| 4,936,415 | 6/1990 | Williams | 182/187 |
| 5,048,504 | 9/1991 | Ballard | 124/86 |
| 5,186,276 | 2/1993 | Craig | 182/187 |
| 5,344,110 | 9/1994 | Scarpa | 248/229.15 |
| 5,377,657 | 1/1995 | Foster et al. | 124/86 |
| 5,482,241 | 1/1996 | Oglesby | 248/309.1 |
| 5,664,750 | 9/1997 | Cohen | 248/229.15 |

*Primary Examiner*—Timothy V. Eley
*Assistant Examiner*—Willie Berry, Jr.
*Attorney, Agent, or Firm*—Joseph N. Breaux

[57] ABSTRACT

A user attachable Weapon Support for supporting either a hunting bow or rifle comprising a clamp assembly for clamping the weapon support to either deer stand, hunting blind, or other stable support, an extendable support arm extending upwardly from the clamp assembly and supporting a weapon cradle including a weapon conforming channel having a resilient retaining arm for contacting and holding the weapon within the channel until needed but that will readily give way and allow for removal of the weapon when an animal is sighted.

2 Claims, 2 Drawing Sheets

WEAPON SUPPORT

TECHNICAL FIELD

The present invention relates to devices and methods for weapon supports and more particularly to devices and methods for a user attachable weapon support for supporting a weapon such as a rifle or hunting bow comprising a clamp assembly for clamping the support to a deer stand, a support arm extending upwardly from the clamp assembly and supporting a cradle including a weapon conforming channel having a resilient retaining arm for contacting and holding the weapon within the channel until needed.

BACKGROUND ART

One method of hunting requires a hunter to sit patiently and undetected for a period of time until a unsuspecting prey walks within range of the hunter's weapon. In order to succeed with this type of hunting procedure the hunter must sit relatively still while maintaining his/her weapon in a ready condition. If the hunter does not have his/her weapon readily available when the prey is within range, the hunters activity in reading the weapon will more than likely alert the prey resulting in an unsuccessful hunt. Maintaining the weapon readily available requires considerable concentration and energy given the duration a hunter must wait. Consequently most hunters are unable to maintain a weapon in a readily available state at all times while hunting. Additionally, some hunting techniques require a hunter to simulate wild life calls using his/her hands. The calling activity necessitates a hunter to sit his/her weapon aside temporarily. Accordingly, there is a need for a weapon support which will maintain a weapon in a ready position while a hunter waits for prey to walk within range of the weapon while also freeing the hands of the hunter for other purposes.

The present invention provides a weapon support which clamps to a hunting stand and which supports either a hunting bow or rifle. Prior to the present invention others have described various weapon supports such as the following:

Oglesby, U.S. Pat. No. 5,482,241 which describes an archery bow support for supporting an archery bow in an upright position when attached to an upstanding support. This invention is extremely useful for supporting an archery bow only however it is not adaptable for use with either an archery bow or rifle as the present invention.

Foster, et al, U.S. Pat. No. 5,377,657 which discloses an archery bow holder for a compound bow. This device similar to Oglesby is not adaptable for use with a rifle as the present invention.

Craig, U.S. Pat. No. 5,186,276 which claims a portable hunting tree stand adaptable to be removably connected to a tree trunk comprising an arm means for hanging a hunting bow to free the hands of the hunter. This device is useful for supporting a hunting bow, but does not provide support which maintains the hunting bow in a ready to use orientation requiring minimal movement of the hunter as the present invention. Additionally, the device claimed by Craig is not adaptable for use with either a rifle or archery bow.

Ballard, U.S. Pat. No. 5,048,504 describes an archery support stand mounted to a top surface of a table. This device is useful as stated therein however it is not adaptable to be attached to numerous types of hunting stands and further is not adaptable with either a archery bow or a rifle as the present invention.

Williams, U.S. Pat. No. 4,936,415 describes a bow holder for a tree stand. This device is also useful for supporting an archery bow as described therein however it is not adaptable for use with either an archery bow or a rifle as the present invention.

Skyba, U.S. Pat. No. 4,729,363 describes a bow rest for a tree stand. This device is also useful for supporting an archery bow however as with other bow stands prior to the present invention the Skyba bow rest is not adaptable for use with either a rifle or a bow.

As will be described below the present invention provides a weapon support suitable for supporting either an archery bow or a rifle which is clampable to numerous types of tree stands and/or hunting blinds thereby allowing the hunter to use the support in numerous situations. The weapon support supports either a rifle or hunting bow in an orientation which is in a position ready for firing without movement or with minimal movement of the weapon. The minimal movement required prevents the hunter from startling the prey.

GENERAL SUMMARY DISCUSSION OF INVENTION

It is thus an object of the present to provide a Weapon Support that is a user attachable weapon support for supporting either a hunting bow or rifle comprising a clamp assembly for clamping the support to a deer stand, hunting blind, tree limb or trunk or any other stable support, including an adjustable extendable support arm extending upwardly from the clamp assembly and supporting a weapon cradle member including a weapon conforming channel having a resilient weapon retaining arm for contacting and holding the weapon within the channel until needed but will readily give way and allow for removal of the weapon from the weapon cradle when an animal is sighted.

It is a further object of the invention to provide a Weapon Support that allows a hunter to free his/her hands while maintaining a weapon in a ready position.

It is a still further object of the invention to provide a Weapon Support that maintains either a rifle or a hunting bow in a ready position so that a hunter may retrieve the weapon and fire the weapon with minimal movement thereby not alerting the prey of the hunter's presence.

It is a still further object of the invention to provide a Weapon Support that holds either a rifle or hunting bow in a ready position thereby preventing the hunter from becoming fatigued while waiting for a prey to come within range of the hunter's weapon.

Accordingly, a Weapon Support is provided which is portable and user attachable for supporting either a hunting bow or a rifle which support comprises a clamp assembly for clamping the support to a deer stand, hunting blind, tree limb, or trunk, or any other stable support that the hunter may utilize for supporting the weapon support, a length adjustable support arm extending upwardly from the clamp assembly and supporting a weapon cradle wherein the weapon cradle includes a weapon conforming channel for receiving the weapon and which channel includes a resilient retaining arm for contacting and holding the weapon within the channel, the resilient retaining arm will readily give way and allow the weapon to be removed from the channel by the hunter when an animal is sighted.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that in use a hunter would simply clamp the weapon support to a deer stand, hunting blind, tree limb or trunk, or any other stable support useful for clamping the weapon support, adjust the length adjustable support arm extending upwardly from the clamp assembly by use of wing nut and bolt adjustment holes install the applicable weapon cradle, either a hunting bow or rifle weapon cradle in position, a weapon is then secured in the weapon channel of the weapon cradle and retained within the channel by use of a resilient retaining member. The user would then be free to enjoy the benefit of having his/her weapon ready at all times, free to use his/her hands for other purposes, and avoid fatigue of holding a weapon in a ready position over an extended period of time. The weapon support allows the hunter to pick-up and utilize the weapon when prey comes into range with very minimal movement of the weapon thereby reducing the chance of spooking the animal. The weapon support may also be used as a prop to help steady the hunter's aim thereby increasing the chance for success.

Figure 1:
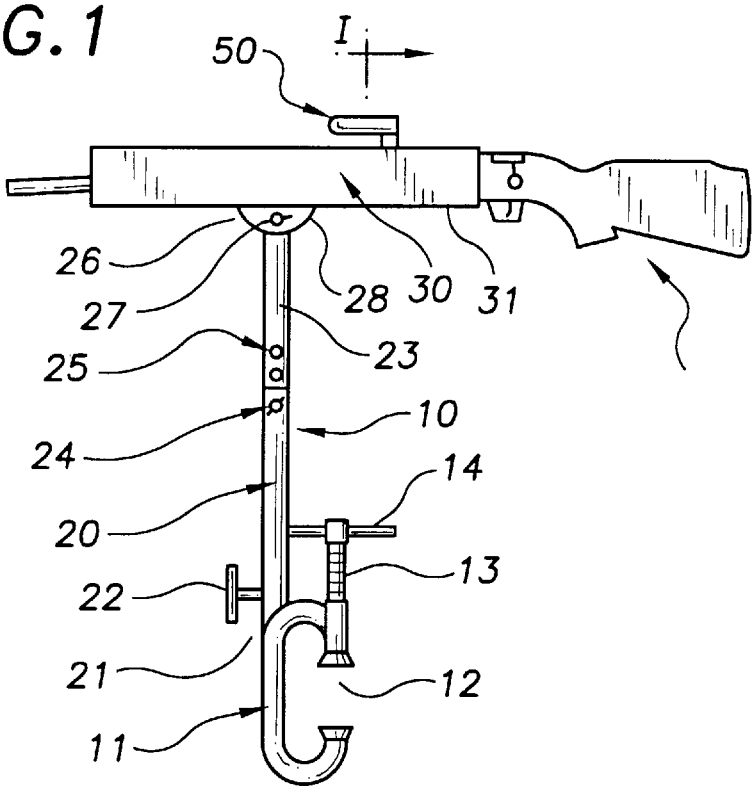
FIG. 1 is a side view of the weapon support illustrating a weapon cradle for use with a hunting rifle.
Figure 3:
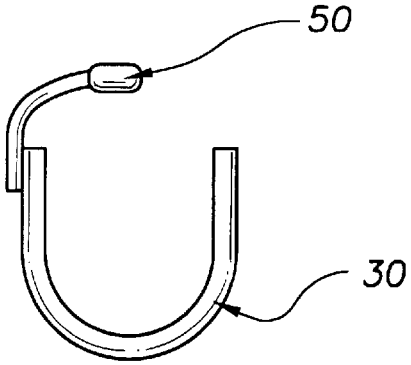
FIG. 3 is a cross sectional view of the weapon cradle for use with a hunting rifle illustrating the resilient weapon retaining arm.
Figure 2:
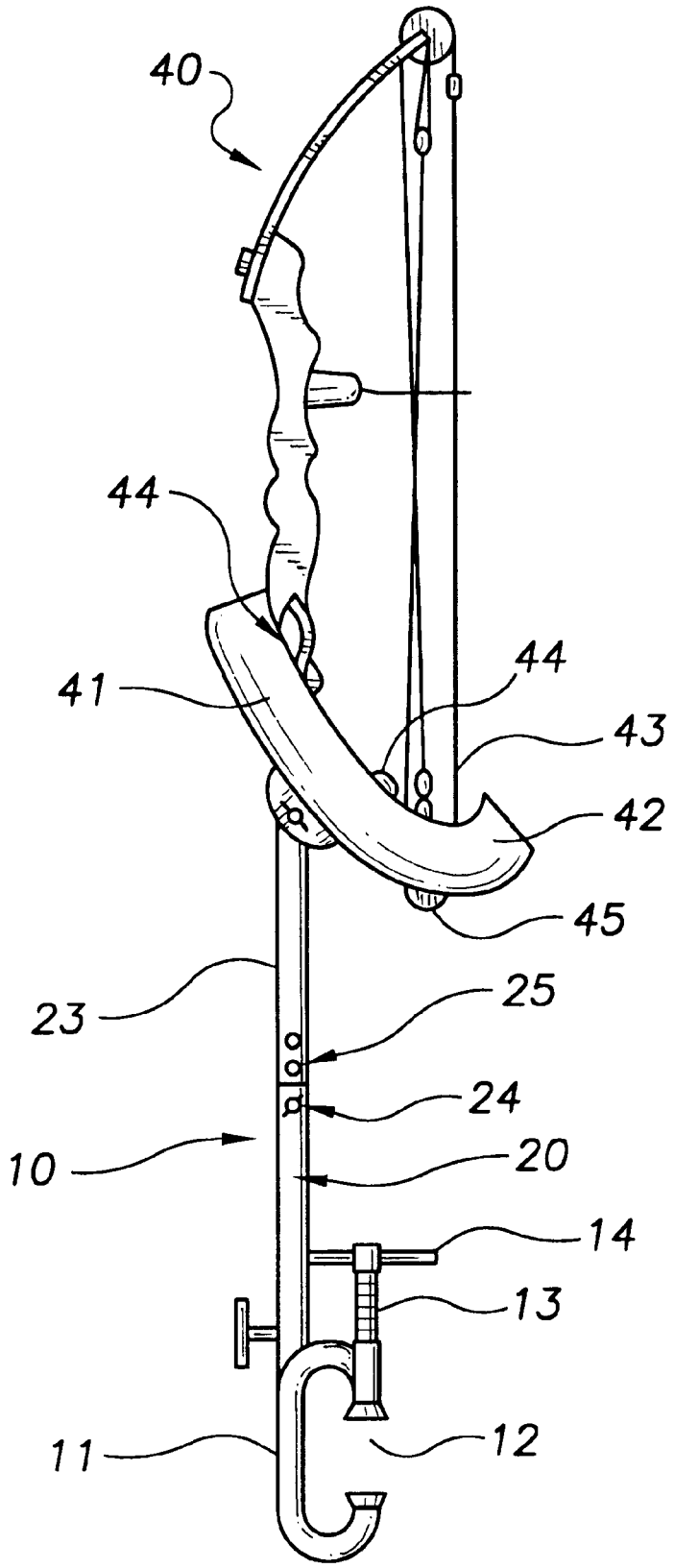
FIG. 2 is a side view of the weapon support illustrating a weapon cradle for use with a hunting bow.

Referring to the figures in detail the Weapon Support 10 is illustrated generally in FIGS. 1 and 2. The weapon support 10 includes a clamping member 11 which is preferably "C" clamp with an opening 12 for inserting any portion of deer stand, hunting blind, tree limb, or any other support available for clamping the device. The "C" clamp includes a threaded clamping ram 13 with a "T" handle 14 for easily turning the threaded ram 13 and clamping the weapon support 10.

An extendable support arm 20 extends upwardly from the clamp 11. The extendable support arm 20 may be fixedly secured to the "C" clamp 11 as illustrated in FIG. 2 or alternatively may be pivotally attached to the "C" clamp with a pivotal attachment 21 with a "T" handled pivotal securing bolt 22 which is threaded into the "C" clamp. The pivotally attached adjustable support arm allows the "C" clamp to be attached to a support which may not be horizontal. The extendable support arm 20 includes an extending portion 23 which extends upwardly from the lower support arm. The support arm length is adjusted by use of a wing nut and bolt through any one of a number of apertures 25 extending through the adjustable support arm. The top portion of the adjustable support arm 26 includes a pivotal attachment for a weapon cradle 30. The pivotal attachment is secured in place by a wing nut and bolt 27 extending through a mounting tab 28 attached to a bottom section 31 of the weapon cradle 30.

FIG. 2 illustrates the weapon support in use on a archery bow 40 with a weapon cradle 41 designed for receiving an archery bow. The weapon cradle 41 includes a lower hooked portion 42 for receiving the lower end 43 of the archery bow. A pair of bow retaining brackets 44 are attached to a top edge of the bow cradle for maintaining the bow within the support cradle. The archery bow support cradle 41 is pivotally attached to the extending support arm 23.

Figure 4:
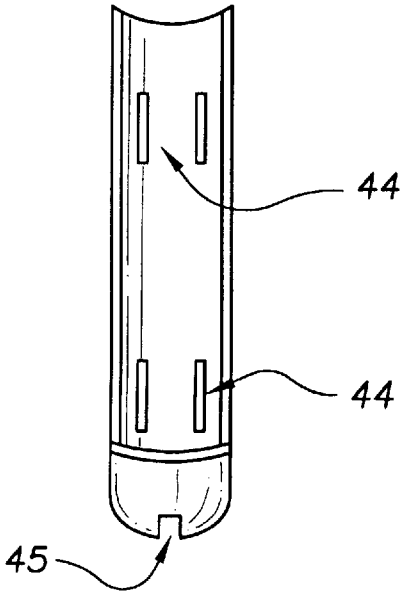
FIG. 4 is a top view of a weapon cradle for supporting a hunting bow.

The resilient retaining member 50 is attached to a top edge of the weapon cradle 30 and is biased to retain the rifle in the cradle 30 and thus prevent the inadvertent removal of the rifle from the cradle. The interior of the cradle is conformed to fit the contours of the rifle so that the rifle positively fits within the cradle. The positioning of the hunting bow retaining brackets 44 are illustrated in FIG. 4 while a hunting bow pulley groove 45 is positioned near the hooked area 42 of the hunting bow cradle 41 to assure the hunting bow is secured in position.

It is noted that the embodiment of the Weapon Support described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A weapon support comprising:

a) a clamping member in the general configuration of a C, with a threaded ram and tee handle attached thereto which provides a means for easily rotating the threaded ram an tightening the clamp to a support, b) an extendable support attached to the clamp member which includes a fixedly secured tubular member attached to the clamp member and extending upwardly from the clamp member which includes an extendable member which slidingly extends from the secured tubular member and wherein the positioning of the extendable member is secured by inserting a bolt through any one of a number of apertures extending through the extendable and secured members, c) a weapon cradle pivotally attached to a top end of the extendable member and secured in position with a bolt extending through a pair of mounting tabs attached to a bottom surface of the cradle and between which is positioned the top end of the extendable member, the weapon cradle includes an interior weapon shaped contour area which helps secure the weapon in position, d) a retaining member extending from a top edge of the weapon cradle and biased to urge the weapon to remain in the weapon cradle but which biasing force is resiliently overcome by a user pulling the weapon from the cradle;

the weapon cradle being a weapon cradle for a hunting bow which further comprises a hooked lower portion which conforms to the shape of an end of a hunting bow, a groove positioned through the cradle which allows the hunting bow lower pulley to project and a pair of retaining brackets positioned on a top edge of the cradle which securely hold the hunting bow in position within the cradle.

2. A weapon support comprising:

a) a clamping member in the general configuration of a C, with a threaded ram and tee handle attached thereto which provides a means for easily rotating the threaded ram an tightening the clamp to a support, b) an extendable support attached to the clamp member which includes a fixedly secured tubular member attached to the clamp member and extending upwardly from the clamp member which includes an extendable member which slidingly extends from the secured tubular member and wherein the positioning of the extendable member is secured by inserting a blot through any one of a number of apertures extending through the extendable and secured members, c) a weapon cradle pivotally attached to a top end of the extendable member and secured in position with a bolt extending through a pair of mounting tabs attached to a bottom surface of the cradle and between which is positioned the top end of the extendable member, the weapon cradle includes an interior weapon shaped contour area which helps secure the weapon in position, d) a retaining member extending from a top edge of the weapon cradle and biased to urge the weapon to remain in the weapon cradle but which biasing force is resiliently overcome by a user pulling the weapon from the cradle;

the clamp member and the extendable support further comprising a pivoting secured support member with allows the clamp member to be clamped in a number of orientations while the extendable support may be pivoted to extend upwardly from the clamp member despite the positioning of the clamp member and then the pivotal attachment secured in place by tightening a tee handled screw.

* * * * *